US006739429B1

(12) United States Patent
Peals

(10) Patent No.: US 6,739,429 B1
(45) Date of Patent: May 25, 2004

(54) CORNER SCAFFOLD STRUCTURE

(76) Inventor: Gregory Peals, 6209 Serenity Ct., Louisville, KY (US) 40219

( * ) Notice: Subject to any disclaimer, the term of this patent is extended or adjusted under 35 U.S.C. 154(b) by 0 days.

(21) Appl. No.: 09/981,407

(22) Filed: Oct. 17, 2001

Related U.S. Application Data

(60) Provisional application No. 60/241,512, filed on Oct. 18, 2000.

(51) Int. Cl.[7] ..... F04G 1/00; F04C 3/38

(52) U.S. Cl. ..... 182/179.1; 182/178.1; 52/638

(58) Field of Search ..... 182/178.1, 179.1, 182/178.5, 186.7, 178.2, 186.6, 186.9; 52/638, 637

(56) References Cited

U.S. PATENT DOCUMENTS

| | | | | |
|---|---|---|---|---|
| 967,803 A | * | 8/1910 | Mercer | 182/178.5 X |
| 3,204,721 A | * | 9/1965 | Park | 182/178.1 X |
| 3,656,269 A | | 4/1972 | Witschel et al. | |

* cited by examiner

*Primary Examiner*—Hugh B. Thompson, II
(74) *Attorney, Agent, or Firm*—Stites & Harbison, PLLC; David W. Nagle, Jr.

(57) ABSTRACT

A corner scaffold structure is comprised of three vertical legs. These three legs are connected to one another at their upper distal ends by three horizontal legs which generally form a right isosceles triangle. Similarly, there are three horizontal legs connected to and joining the vertical legs near the lower distal ends thereof. Because of the three-dimensional geometry of the corner scaffold structure, multiple hop irons can be secured to each side of the structure to provide additional support to scaffold planks, increasing their stability.

9 Claims, 8 Drawing Sheets

CORNER SCAFFOLD STRUCTURE

CROSS-REFERENCE TO RELATED APPLICATIONS

The present application claims priority from U.S. provisional application No. 60/241,512 filed Oct. 18, 2000, the entire disclosure of which is incorporated herein by reference.

BACKGROUND OF THE INVENTION

The present invention relates to a scaffold structure positioned for accessing a corner of a construction area, a free-standing structure that can be incorporated into and used in conjunction with existing modular supports used in scaffold assembly.

Scaffolds are widely used in industrial, commercial, and residential construction settings for supporting workers and equipment. Scaffolds are erected as free-standing structures along and beside surfaces or areas where work is to be performed, allowing workers access to such surfaces or areas. Thus, scaffolds must be rigid enough to safely support workers and their equipment, yet easily assembled and disassembled Scaffolds generally are assembled from a plurality of modular supports coupled by horizontal or diagonal braces to create frames. Secured to these frames are horizontal members, often referred to as "hop irons," for supporting scaffold planks. Workers can travel across these planks to access the working surface or area.

FIG. 1 is a perspective view of a common prior art scaffolding arrangement positioned for accessing a corner of a construction area, the intersection of two perpendicularly oriented walls. As shown in FIG. 1, the assembled scaffold comprises two modular supports 12, 14. These two supports 12, 14 are connected to one another and supported by opposing pairs of diagonal and intersecting braces 18, 20. Extending from and secured to the supports 12, 14 are three hop irons 22, 24, 26. These hop irons 22, 24, 26 provide support for two scaffold planks 28, 30 (shown in phantom) which extend into the corner of the construction area and are oriented perpendicular to one another.

This prior art scaffolding arrangement presents some attendant dangers. First and foremost, there is often a significant unsupported span between hops irons, for example, the span of the scaffold plank 28 between hop iron 22 and hop iron 24. This may cause the plank 28 to sag significantly as a worker walks along the plank 28. Secondly, due to minimal underlying support (i.e. few hop irons), if a worker were to walk to the end of a particular plank, it is possible that his weight would be sufficient to cause the opposite end of the plank to "kick up," causing the worker to fall. To prevent such a "kick up" hazard, it is common to strap or otherwise secure the scaffold planks to the hop irons; however, this requires significantly more labor time in the assembly and disassembly of the scaffold.

Furthermore, prior art scaffolding arrangements create some accessibility problems. For example, as shown in FIG. 1, to access into the space enclosed by the modular supports 12, 14 and pairs of braces 18, 20 would require a worker to crawl through the modular supports 12, 14 or under the braces 18, 20. This could prove problematic if a worker was attempting to deliver materials to others working in the corner of the construction area.

It is therefore a paramount object of the present invention to provide a corner scaffold structure that appropriately supports workers and equipment and allows a worker to access a corner of a construction area without subjecting that worker to unnecessary danger.

It is a further object of the present invention to provide a corner scaffold structure that is free-standing.

It is still a further object of the present invention to provide a corner scaffold structure that includes double latch connectors that facilitate attachment and detachment of braces that secure the corner scaffold structure to adjacent modular supports.

It is still a further object of the present invention to provide a corner scaffold structure that includes adjustable braces to allow for more versatility in assembling a scaffold at a particular construction site, specifically, allowing for adjustments to the span between adjacent modular supports and the corner scaffold structure.

It is still a further object of the present invention to provide a corner scaffold structure that allows for the attachment of a diagonally oriented hop iron to the vertex of the generally isosceles triangle formed by the corner scaffold structure such that the hop iron would extend into the corner of a construction area, thereby supporting the scaffold planks at the intersection of their respective distal ends.

These and other objects and advantages of the present invention will become apparent upon a reading of the following description.

SUMMARY OF INVENTION

The present invention is a corner scaffold structure preferably comprised of three vertical legs. These three legs are connected to one another at their upper distal ends by three horizontal legs which generally form a right isosceles triangle. Similarly, there are three horizontal legs connected to and joining the vertical legs near the lower distal ends thereof.

To allow for connection of braces that join the corners of the corner scaffold structure to adjacent modular supports, a plurality of rods are joined to and extend from the corner scaffold structure. In one preferred embodiment, there are at least two corresponding pairs of rods secured to and extending from each of the two outer vertical legs of the corner scaffold structure. A preferred double latch connector fits over each pair of rods and can be manipulated to attach or detach a particular brace to the corner scaffold structure.

Because of the three-dimensional geometry of the corner scaffold structure, multiple hop irons can be secured to each side of the structure to provide additional support to scaffold planks, increasing their stability. It is further contemplated that adjustable braces be used with the corner scaffold structure of the present invention in securing it to adjacent modular supports, thus allowing for more versatility in assembling a scaffold at a particular construction site, and perhaps most importantly, would allow for shortening of potentially dangerously long, unsupported spans between the corner scaffold structure and adjacent modular supports.

DETAILED DESCRIPTION OF THE PRESENT INVENTION

Figure 1:
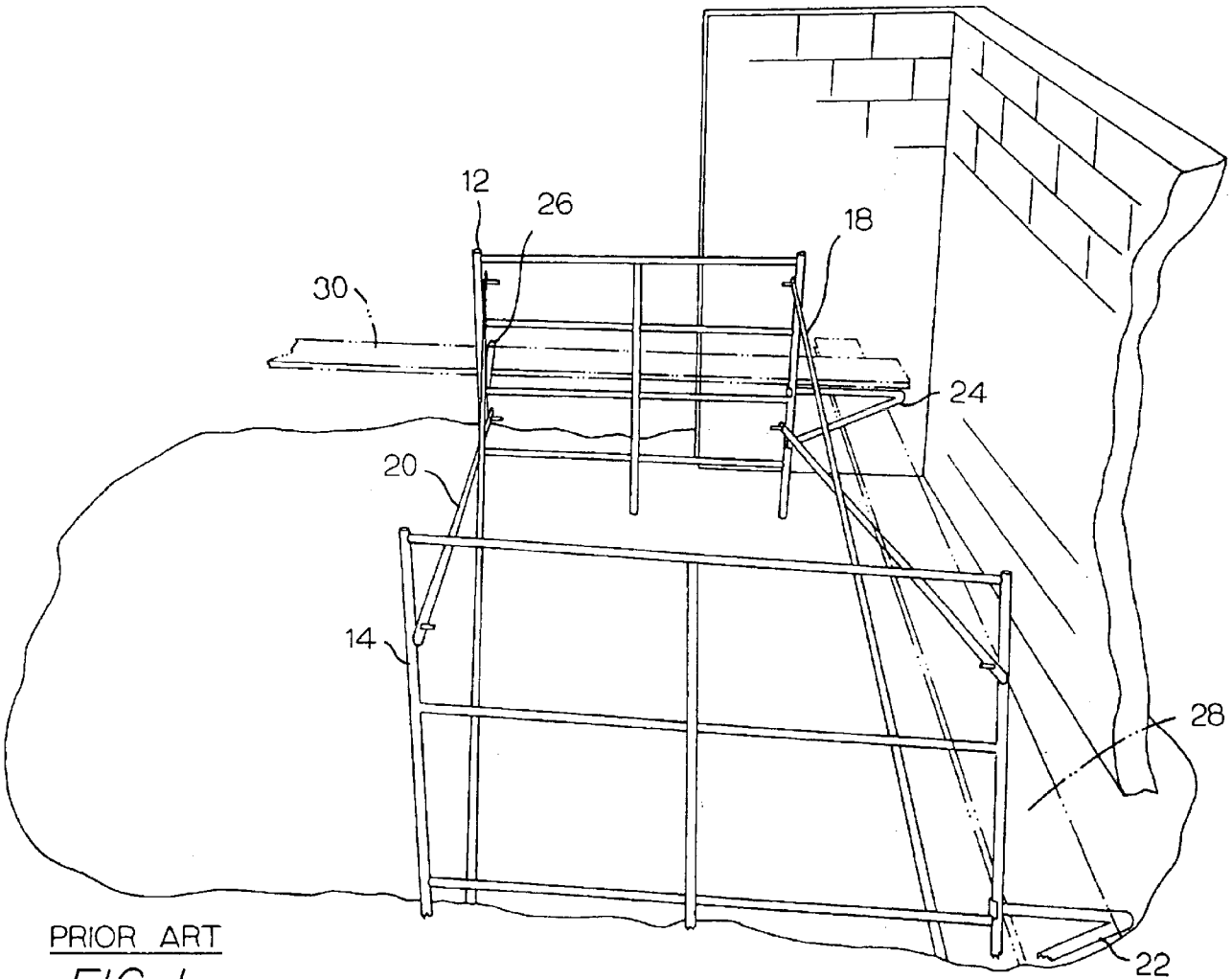
PRIOR ART FIG. 1
FIG. 1 is a perspective view of a common prior art scaffolding arrangement positioned for accessing a corner of a construction area, the intersection of two perpendicularly oriented walls.
Figure 2:
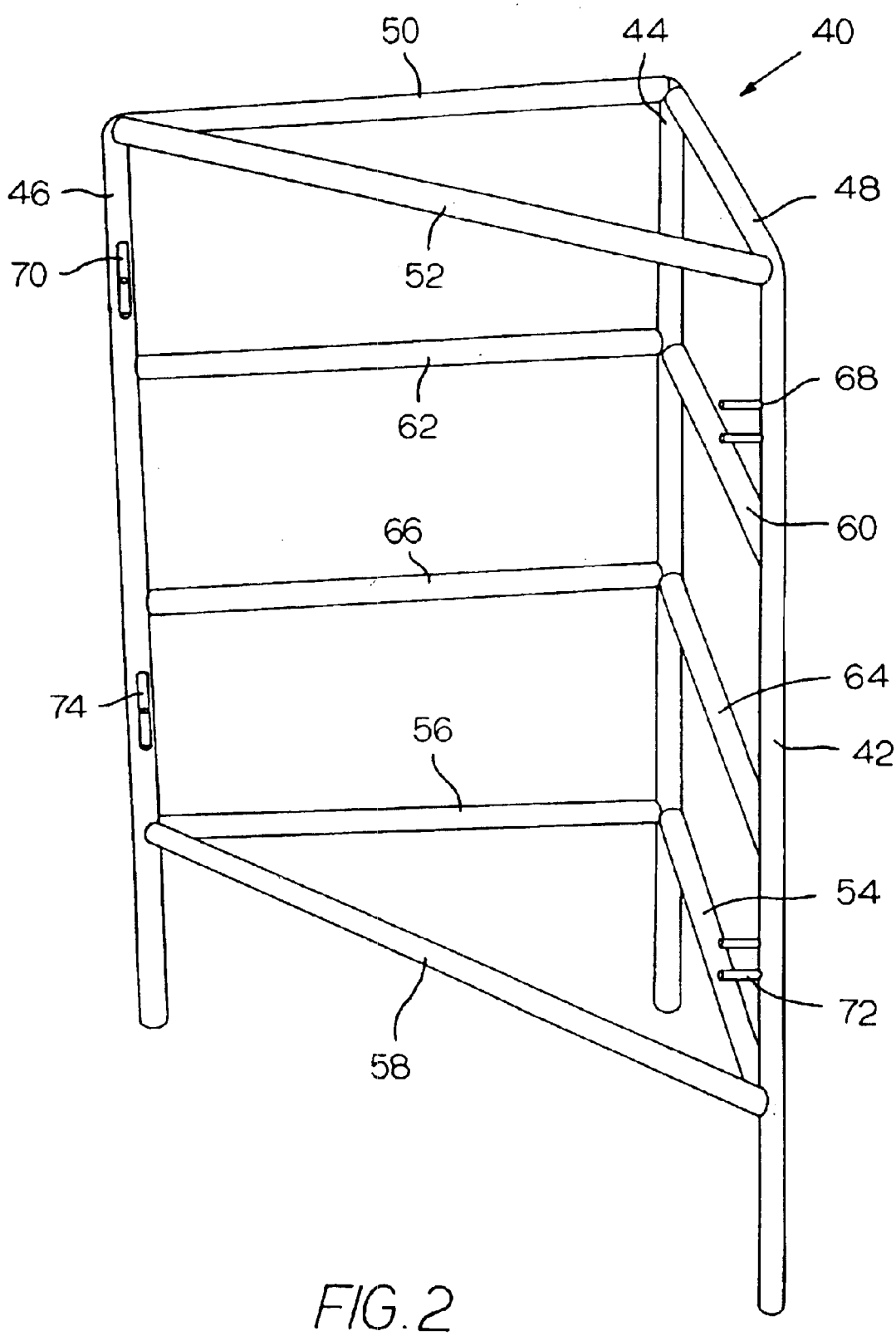
FIG. 2 is a perspective view of a preferred corner scaffold structure made in accordance with the present invention.

The present invention is a corner scaffold structure. Referring to FIG. 2, a corner scaffold structure 40 in accordance with the present invention is comprised of three vertical legs 42, 44, 46. These three legs 42, 44, 46 are connected to one another at their upper distal ends by three horizontal legs 48, 50, 52 which generally form a right isosceles triangle. Similarly, there are three horizontal legs 54, 56, 58 connected to and joining the vertical legs 42, 44, 46 near the lower distal ends thereof. Finally, in this preferred embodiment, there are two pairs of horizontal steps 60, 62, 64, 66 incorporated into the scaffold structure 40. Of course, more or fewer steps could be incorporated into the scaffold structure 40 without departing from the spirit and scope of the present invention.

It is important to note that the corner scaffold structure 40 of the present invention is a free-standing structure; however, to allow for connection of braces that join the corner scaffold structure 40 to adjacent modular supports, a plurality of rods are joined to and extend from the corner scaffold structure 40. Specifically, in the preferred embodiment of FIG. 2, there are corresponding first pairs of rods 68, 70 secured to and extending from the two "outer" vertical legs 42, 46 near the upper distal ends thereof. Similarly, there are corresponding second pairs of rods 72, 74 secured to and extending from the two "outer" vertical legs 42, 46 near the lower distal ends thereof. Of course, fewer or more rods could be incorporated into the corner scaffold structure 40 without departing from the spirit and scope of the present invention. Moreover, such rods could be oriented to various directions relative to the vertical legs 42, 44, 46 to allow bracing in multiple directions.

Figure 2A:
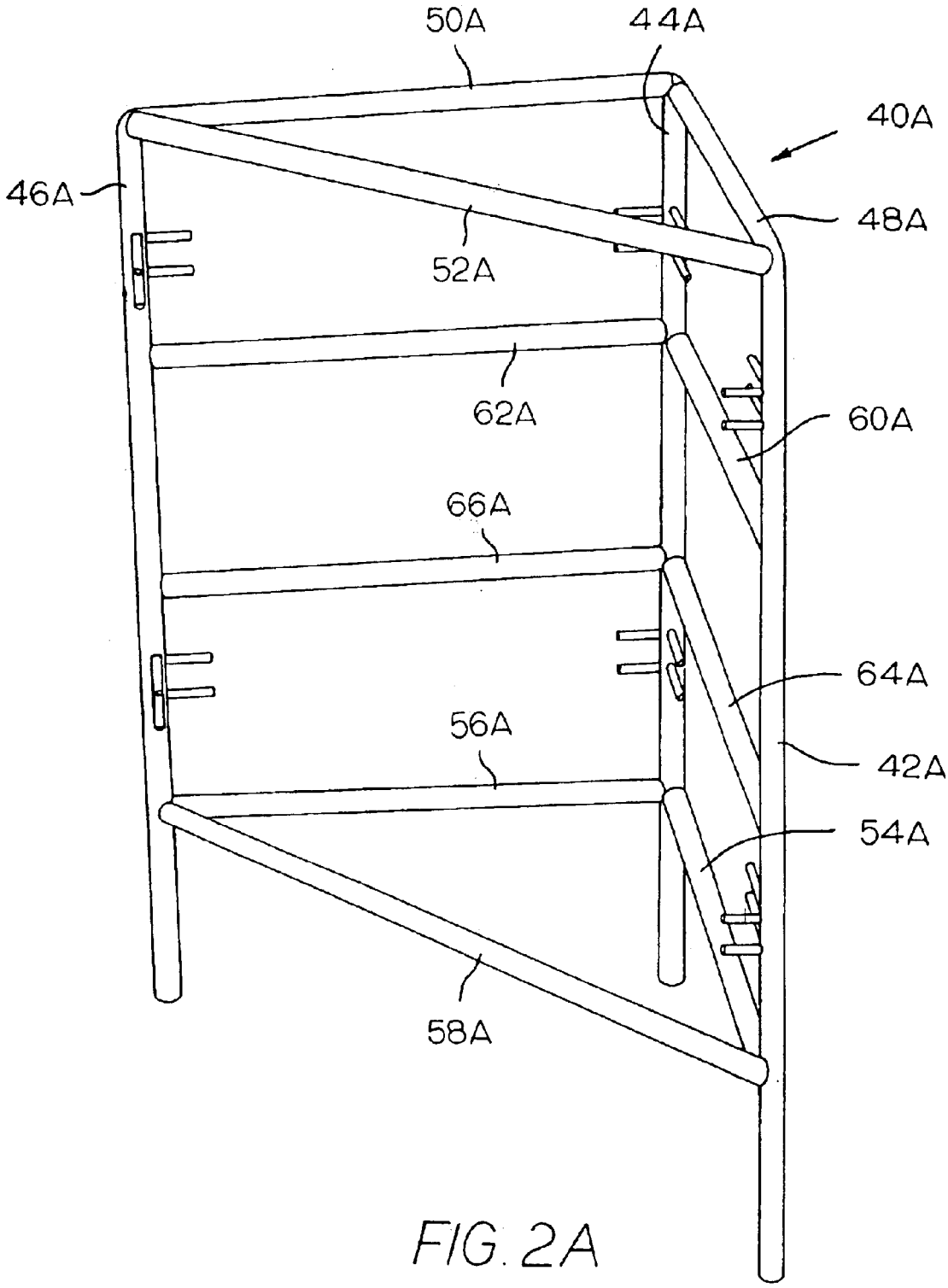
FIG. 2A is a perspective view of another preferred corner scaffold structure made in accordance with the present invention.

FIG. 2A depicts an alternate preferred embodiment of the corner scaffold structure of the present invention. This corner scaffold structure 40A is also comprised of three vertical legs 42A, 44A, 46A, and these three legs 42A, 44A, 46A are connected to one another at their upper distal ends by three horizontal legs 48A, 50A, 52A. Again, there are also three horizontal legs 54A, 56A, 58A connected to and joining the vertical legs 42A, 44A, 46A near the lower distal ends thereof, and there are two pairs of horizontal steps 60A, 62A, 64A, 66A incorporated into the scaffold structure 40A.

As mentioned above, to allow for connection of braces that join the corner scaffold structure 40A to adjacent modular supports, a plurality of rods are joined to and extend from the corner scaffold structure 40A. In this particular, there are two pairs of rods secured to and extending from each vertical leg 42A, 44A, 46A near the upper distal ends thereof. Similarly, there are two pairs of rods secured to and extending from each vertical leg 42A, 44A, 46A near the lower distal ends thereof These twelve pairs of rods allow bracing to adjacent modular supports in multiple directions.

Figure 3:
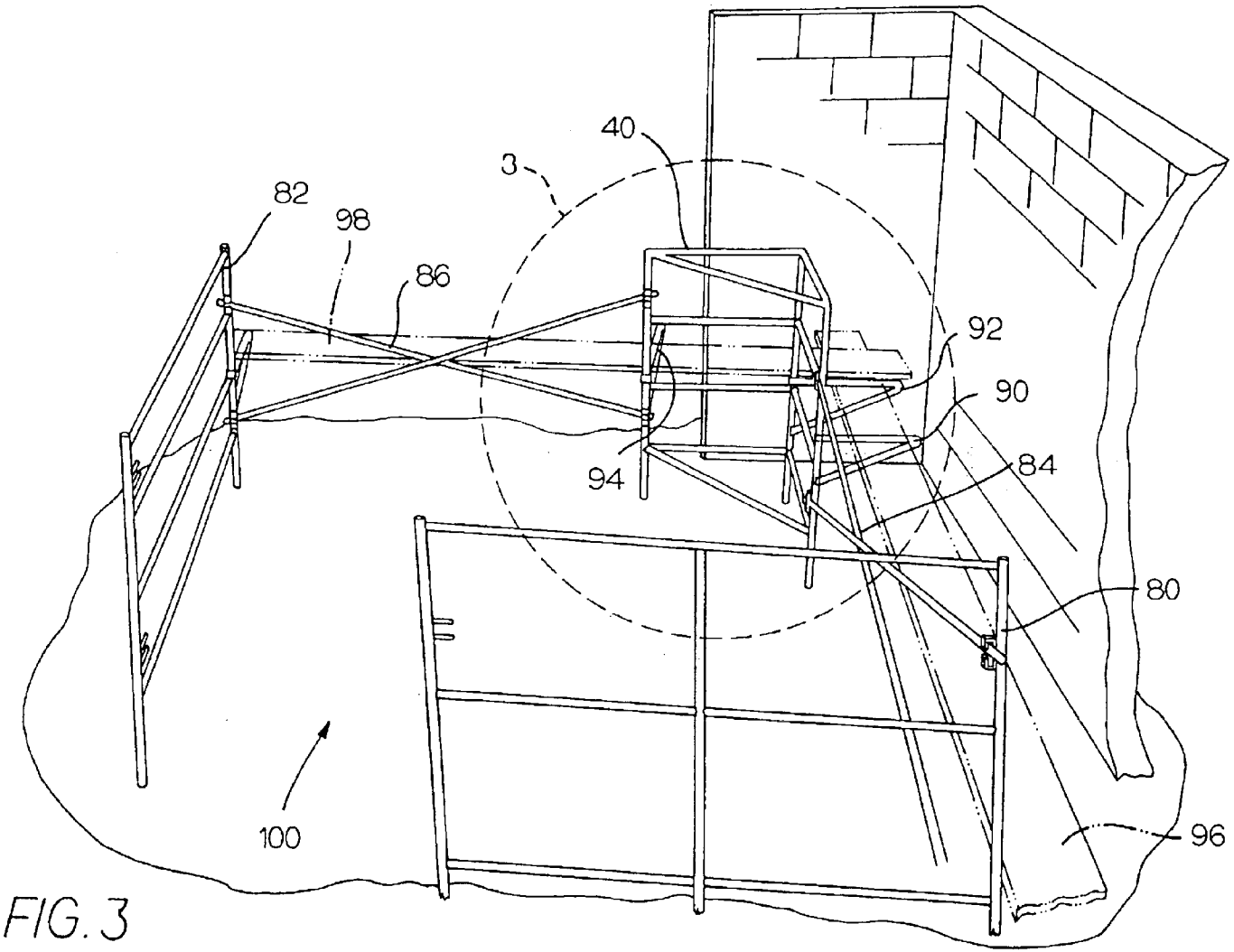
FIG. 3 is a perspective view of a scaffolding arrangement incorporating the corner scaffold structure of FIG. 2 in a position for accessing a corner of a construction area, the intersection of two perpendicularly oriented walls.

FIG. 3 is a perspective view of a scaffolding arrangement incorporating the corner scaffold structure 40 of FIG. 2 in a position for accessing a corner of a construction area, the intersection of two perpendicularly oriented walls. For further detail, FIG. 4 is an enlarged perspective view of the corner scaffold structure 40 in the scaffolding arrangement of FIG. 3.

Figure 4:
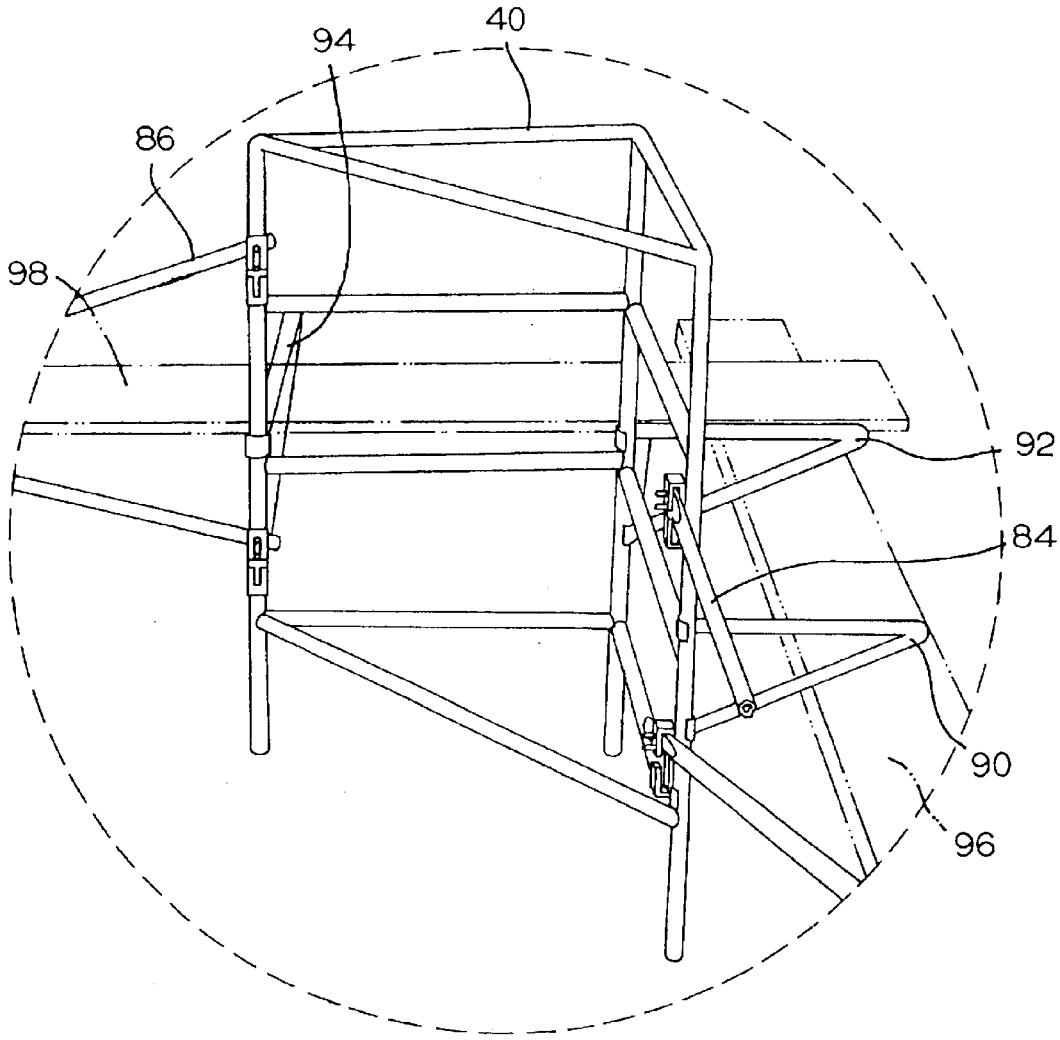
FIG. 4 is an enlarged perspective view of the scaffolding arrangement of FIG. 3 to provide a more detailed view of the corner scaffold structure.
Figure 5:
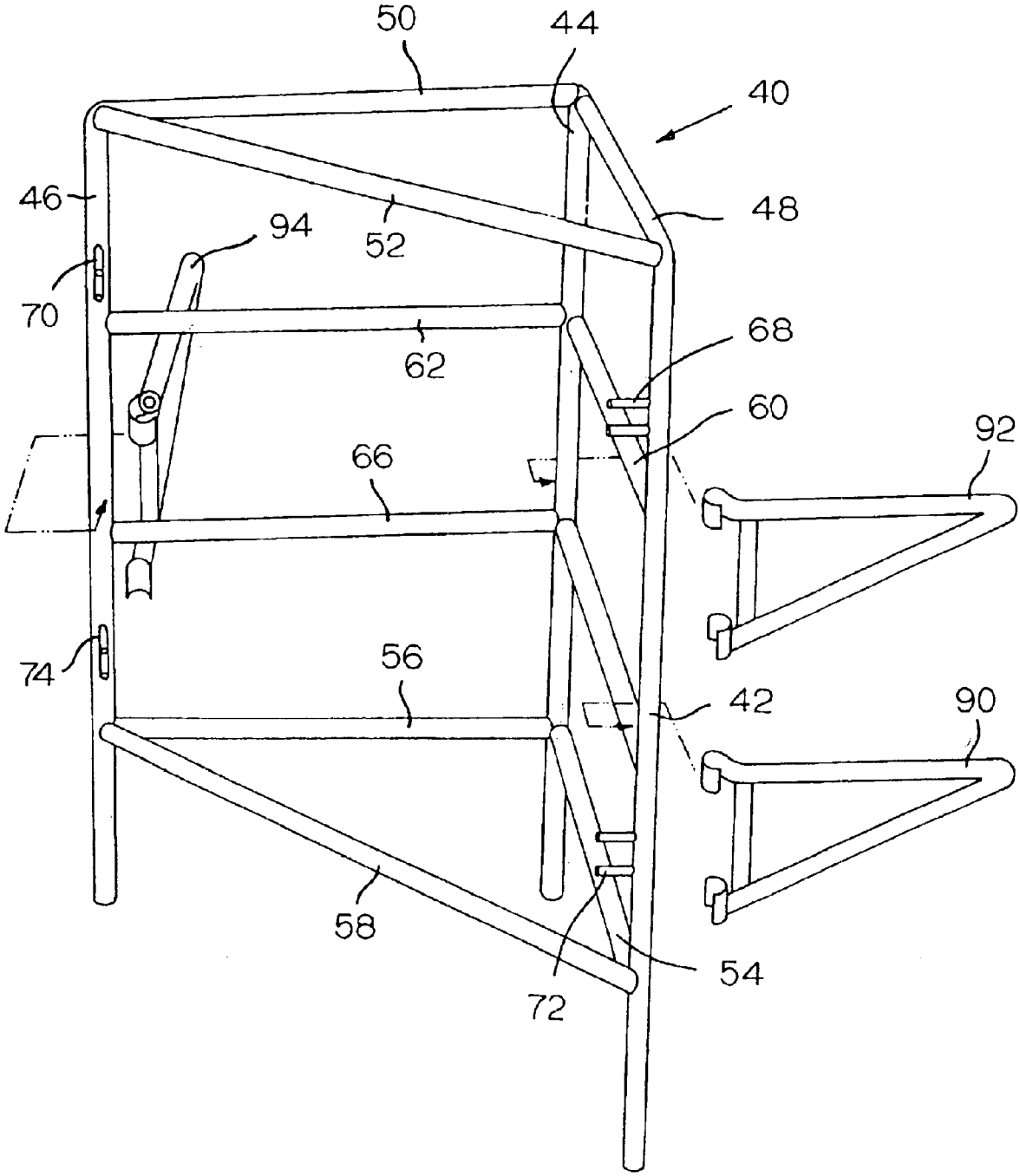
FIG. 5 is a perspective view of the corner scaffold structure of FIG. 2, demonstrating the attachment of multiple hop irons to the corner scaffold structure.
Figure 6:
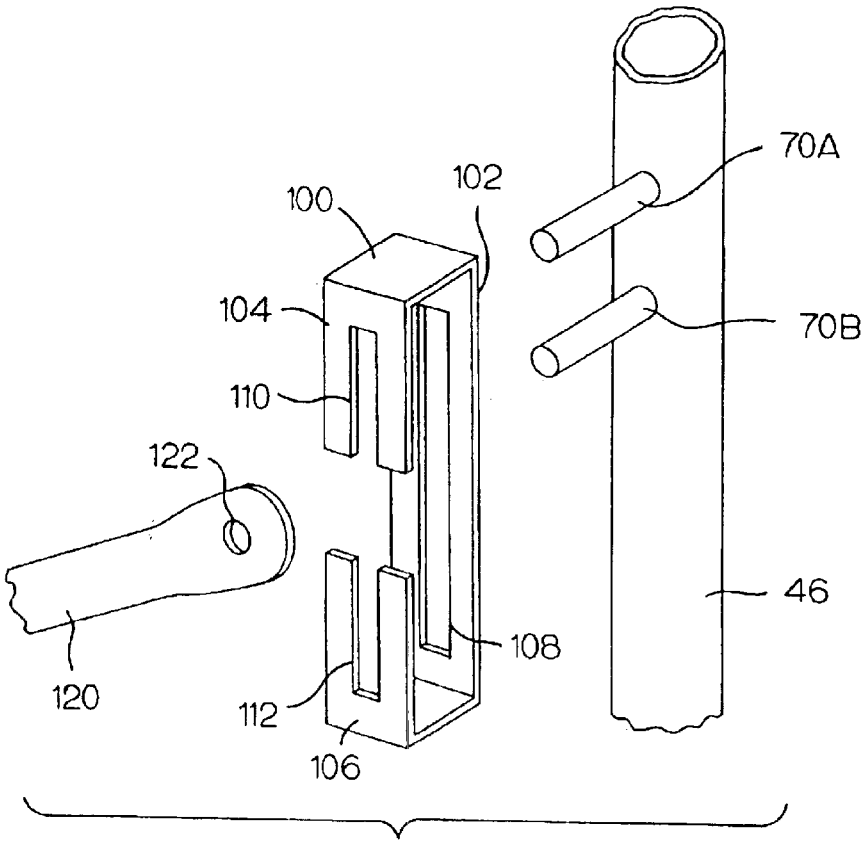
FIGS. 6–9 are detailed perspective views of the attachment of a brace to the corner scaffold structure using a double latch connector in accordance with the present invention.

As shown in FIGS. 3 and 4, the preferred corner scaffold structure 40 is secured to adjacent modular supports 80, 82 through the use of pairs of diagonal and intersecting braces 84, 86. In this exemplary configuration, there are three hop irons 90, 92, 94 employed to support the two scaffold planks 96, 98 (shown in phantom) which extend into the corner of the construction area—one hop iron 94 along the back wall of FIG. 3 and two hop irons 90, 92 along the right wall of FIG. 3. For further detail on the attachment of the hop irons, 90, 92, 94, reference is made to FIG. 5. In short, because of the three-dimensional geometry of the corner scaffold structure 40, multiple hop irons can be secured to each side of the structure 40 to provide additional support to the scaffold planks 96, 98 to increase their stability.

Although not specifically shown in the Figures, it is further contemplated that adjustable braces be used with the corner scaffold structure 40 of the present invention in securing it to adjacent modular supports. Specifically, the length of each brace would be adjustable, which preferably would be accomplished through a telescoping brace construction in which a first portion of the brace has a reduced diameter allowing it to fit within a second portion of the brace. The first and second portions of the brace could thus be moved relative to one another, and then secured relative to one another with a tightening device, pin or similar securing means to fix the length of the brace. Such securing means are well-known in the art. The use of such adjustable braces with the corner scaffold structure 40 of the present invention would allow for more versatility in assembling a scaffold at a particular construction site, and perhaps most importantly, would allow for the shortening of potentially dangerously long, unsupported spans between the corner scaffold structure 40 and adjacent modular supports.

Referring again to FIG. 3, when the corner scaffold structure 40 is secured to the adjacent modular supports 80, 82 in this particular configuration, there remains a gap between the modular supports 80, 82, generally referred to by referenced numeral 100. This allows a worker to access the substantially enclosed space without requiring the worker to crawl through the modular supports 80, 82 or under the braces 84, 86.

As a further refinement, although not shown in the Figures, it is contemplated and preferred that a hop iron be specially adapted to be secured to the vertex of the isosceles triangle formed by the scaffold structure 40 such that the hop iron could be positioned to extend into the corner of the construction area diagonally, thereby supporting the scaffold planks 96, 98 of FIGS. 3 and 4 at the intersection of their respective distal ends, thereby providing additional support to the planks. Specifically, such a hop iron would support the scaffold planks nearer their respective distal ends, thereby reducing the likelihood that weight applied near the distal end of a scaffold plank will cause the plank to rapidly and unexpectedly "kick up" at the opposite end.

FIGS. 6–9 are detailed perspective views of the attachment of a brace 120 to the corner scaffold structure 40 of the present invention using a preferred double latch connector 100. Specifically, as mentioned above with reference to FIG. 2, there are corresponding first pairs of rods 68, 70 secured to and extending from the two "outer" vertical legs 42, 46 of the corner support structure 40 near the upper distal ends thereof Similarly, there are corresponding second pairs of rods 72, 74 secured to and extending from the two "outer" vertical legs 42, 46 near the lower distal ends thereof.

FIGS. 6–9 show a single pair of rods 70 (individually indicated by reference numerals 70A and 70B) secured to and extending from one of the outer vertical legs 46 of the corner scaffold structure 40. A double latch connector 100 in accordance with the present invention has a generally C-shaped cross-section, having a rear surface 102 and upper and lower front surfaces 104, 106. The rear surface 102 defines an elongated slot 108 adapted to receive the rods 70A, 70B. The upper and lower front surfaces 104, 106 similarly define elongated slots 110, 112 adapted to receive the rods 70A, 70B. Each of the elongated slots 110, 112 defined through the respective front surfaces 104, 106 has an open end and a closed end. The brace 120 to be secured to the corner scaffold structure 40 defines an opening 122 near its distal end having substantially the same cross-sectional geometry as the rod 70B to which it is to be attached.

Figure 7:
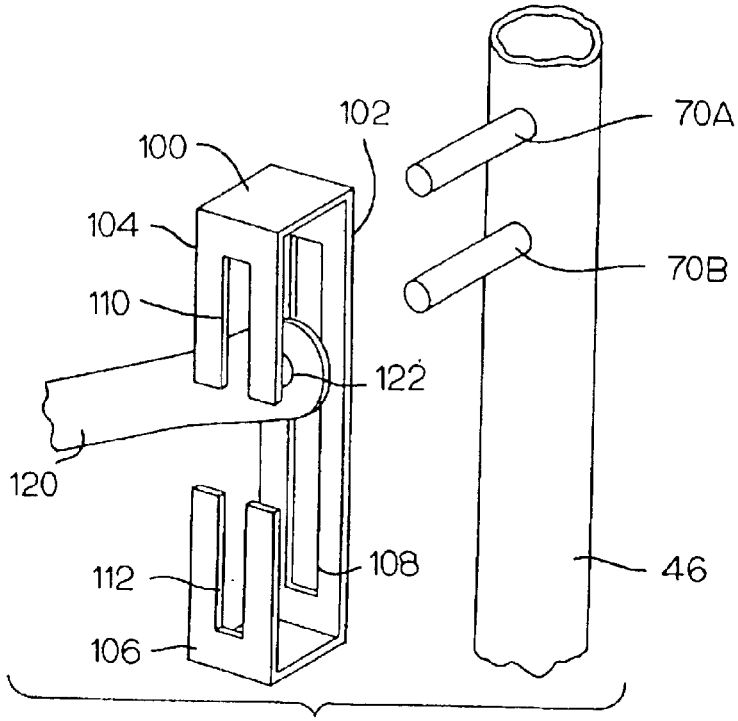
Figure 8:
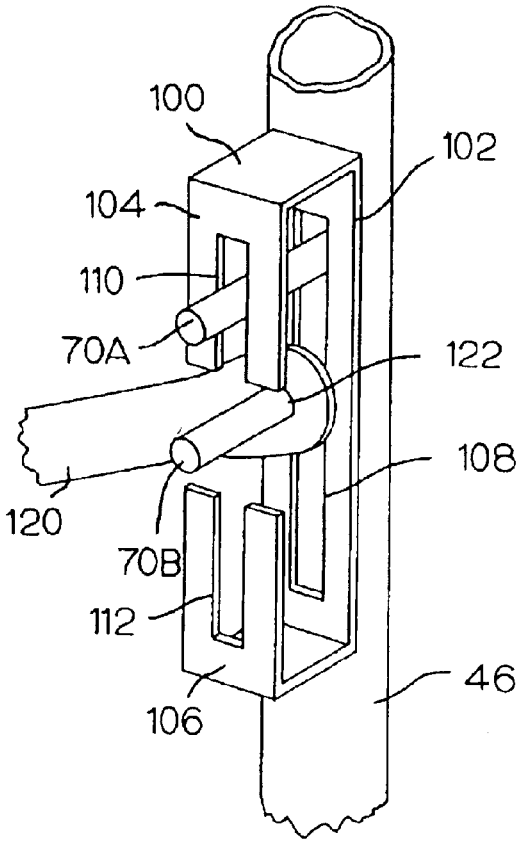
Figure 9:
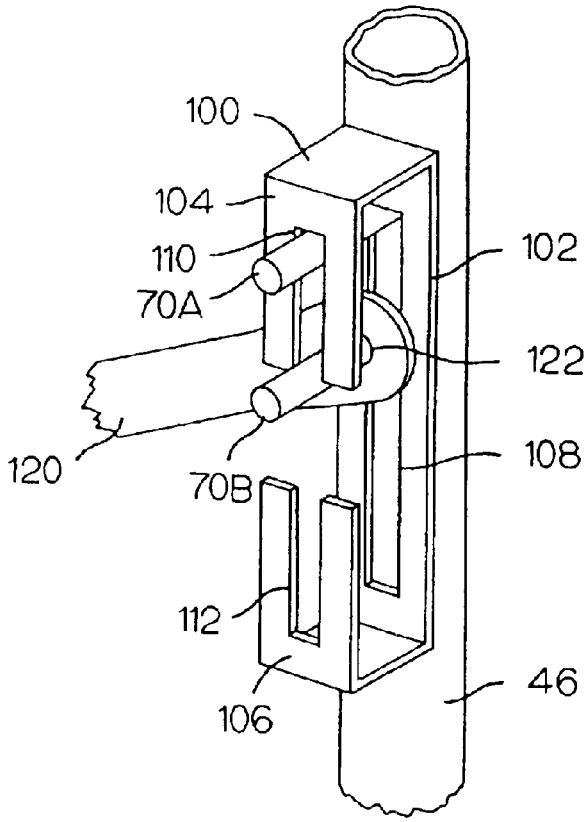

Referring to FIGS. 7–9, the distal end of the brace 120 fits between the rear surface 102 and upper and lower front surfaces 104, 106 of the latch connector 100. Specifically, this latch connector 100 fits over the rods 70A, 70B secured to and extending from the outer vertical leg 46 of the corner scaffold structure 40. To position the brace 120, the latch connector 100 is forced upwardly to the position shown in FIG. 8. The opening 122 defined by the brace 120 is then fit over the lower rod 70B. The latch connector 100 is then forced downwardly until the upper rod 70A stops it, so that the upper rod 70A is snugly secured against the closed end of the elongated slot 110 defined by the upper front surface 104, and both rods 70A, 70B are enclosed within the elongated slot 110. The brace 120 is now appropriately secured relative to the corner scaffold structure 40, as shown in FIG. 9. In this regard, the elongated slots 110, 112 defined by the upper and lower front surfaces 104, 106 of the latch connector 100 are each appropriately sized so as to tightly engage the rods 70A, 70B in a frictional relationship so as to prevent inadvertent movements of the latch connector 100 relative to the rods 70A, 70B.

To remove the brace, the latch connector 100 is forced upwardly and returned to the position shown in FIG. 8, and the brace 120 can be withdrawn.

Furthermore, by using such a connector 100, should the corner scaffold structure be inverted for use in a scaffolding arrangement, the latch connector 100 can still function with the brace 120 being secured to the other rod 70A.

The double latch connectors 100 described above can also be used on standard modular scaffold supports without departing from the spirit and scope of the present invention.

It will be obvious to those skilled in the art that further modifications may be made to the embodiments described herein without departing from the spirit and scope of the present invention.

What is claimed is:

1. A corner scaffold structure, comprising:

three substantially vertical legs;

three upper, substantially horizontal legs secured to and connecting said three substantially vertical legs at the upper distal ends thereof and forming a first triangle;

three lower, substantially horizontal legs secured to and connecting said three substantially vertical legs and forming a second triangle that is substantially parallel to said first triangle;

first and second upper rods secured to and extending from at least one of said vertical legs near the upper distal end thereof, each of said rods adapted for receiving and securing a brace, thereby allowing for the connection of said corner scaffold structure to an adjacent scaffold structure;

first and second lower rods secured to and extending from at least one of said vertical legs, each of said rods also adapted for receiving and securing a brace, thereby allowing for the connection of said corner scaffold structure to an adjacent scaffold structure; and one or more double latch connectors, each of said connectors having a generally C-shaped cross-section and comprising:

a rear surface defining an elongated slot adapted to receive first and second rods, and upper and lower front surfaces, each defining an elongated slot having an open end and a closed end adapted to receive first and second rods, wherein a brace defining an opening near its distal end can be fit over one of said rods and secured between the rear surface and the upper front surface of said latch connector.

2. The corner scaffold structure as recited in claim 1, and further comprising at least one pair of horizontal steps disposed between the upper horizontal legs and the lower horizontal legs.

3. A scaffold assembly including:

one or more scaffold planks;

a first scaffold structure;

a second corner scaffold structure, comprising three substantially vertical legs, three upper, substantially horizontal legs secured to and connecting said three substantially vertical legs at the upper distal ends thereof and forming a first triangle, three lower, substantially horizontal legs secured to and connecting said three substantially vertical legs and forming a second triangle that is substantially parallel to said first triangle, and at least one upper rod and at least one lower rod secured to and extending from one of said vertical legs, each of said rods adapted for receiving and securing a brace extending from the first scaffold structure, thereby allowing for the connection of said corner scaffold structure to the first scaffold structure; and a plurality of hop irons removably secured to said corner scaffold structure for supporting said scaffold planks along outer surfaces of said corner scaffold structure.

4. The scaffold assembly as recited in claim 3, and further including:

first and second upper rods secured to and extending from a first vertical leg near the upper distal end thereof;

first and second lower rods secured to and extending from the first vertical leg;

first and second upper rods secured to and extending from a second vertical leg near the upper distal end thereof; and first and second lower rods secured to and extending from the second vertical leg.

5. The scaffold assembly as recited in claim 4, and further including:

adjacent first and second modular supports; and a pair of diagonal and intersecting braces securing each modular support to said corner scaffold structure.

6. The scaffold assembly as recited in claim 5, wherein:

a first pair of diagonal and intersecting braces is secured to said corner scaffold structure with one brace attached to one of said upper rods extending from the first vertical leg, and the second brace attached to one of said lower rods and extending from the first vertical leg; and a second pair of diagonal and intersecting braces is secured to said corner scaffold structure with one brace attached to one of said upper rods extending from the second vertical leg, and the second brace attached to one of said lower rods and extending from the second vertical leg.

7. The scaffold assembly as recited in claim 3, wherein said plurality of hop irons includes a hop iron secured to the vertex of an isosceles triangle formed by the corner scaffold structure such that the hop iron extends diagonally from the corner scaffold structure.

8. A scaffold assembly including:

one or more scaffold planks;

a corner scaffold structure, comprising three substantially vertical legs, three upper, substantially horizontal legs secured to and connecting said three substantially vertical legs at the upper distal ends thereof and forming a first triangle, three lower, substantially horizontal legs secured to and connecting said three substantially vertical legs and forming a second triangle that is substantially parallel to said first triangle, first and second upper rods secured to and extending from a first vertical leg near the upper distal end thereof, first and second lower rods secured to and extending from the first vertical leg, first and second upper rods secured to and extending from a second vertical leg near the upper distal end thereof, and first and second lower rods secured to and extending from the second vertical leg, each of said rods adapted for receiving and securing a brace, thereby allowing for the connection of said corner scaffold structure to an adjacent scaffold structure;

a plurality of hop irons removably secured to said corner scaffold structure for supporting said scaffold planks;

adjacent first and second modular supports; and a pair of diagonal and intersecting braces securing each modular support to said corner scaffold structure.

9. The scaffold assembly as recited in claim 8, wherein:

a first pair of diagonal and intersecting braces is secured to said corner scaffold structure with one brace attached to one of said upper rods extending from the first vertical leg, and the second brace attached to one of said lower rods and extending from the first vertical leg; and a second pair of diagonal and intersecting braces is secured to said corner scaffold structure with one brace attached to one of said upper rods extending from the second vertical leg, and the second brace attached to one of said lower rods and extending from the second vertical leg.

* * * * *